United States Patent [19]

Pilch

[11] 4,355,945

[45] Oct. 26, 1982

[54] TOOL MOUNTING APPARATUS

[75] Inventor: John S. Pilch, Ware, Mass.

[73] Assignee: Ware Machine Service, Inc., Ware, Mass.

[21] Appl. No.: 99,518

[22] Filed: Dec. 3, 1979

[51] Int. Cl.[3] ..... B66F 9/00; E02F 3/74

[52] U.S. Cl. ..... 414/686; 414/723; 172/274

[58] Field of Search ..... 414/723, 686; 37/117.5; 172/272–275

[56] References Cited

U.S. PATENT DOCUMENTS

| | | | |
|---|---|---|---|
| 3,614,134 | 10/1971 | Moriceau et al. | 172/274 X |
| 3,672,521 | 6/1972 | Bauer et al. | 414/723 |
| 3,818,551 | 6/1974 | Coughran, Jr. | 414/723 X |
| 3,844,425 | 10/1974 | Bailey | 172/274 X |
| 4,043,470 | 8/1977 | Pilch | 414/686 |

FOREIGN PATENT DOCUMENTS

| | | | |
|---|---|---|---|
| 604911 | 4/1978 | U.S.S.R. | 414/723 |

*Primary Examiner*—Charles A. Marmor

*Attorney, Agent, or Firm*—Thompson, Birch, Gauthier & Samuels

[57] ABSTRACT

A tool mounting apparatus is disclosed for detachably mounting a tool component such as for example a bucket, on a carrier such as for example the dipper stick of a backhoe. A power hitch component is connected to the carrier. Notches on one of the components are arranged to receive a first engagement member(s) on the other component. A support surface on the power hitch component is arranged to engage a second engagement member(s) on the tool component. A power actuated locking member is mounted on the power hitch component for movement between an unlocked position permitting relative engagement and disengagement between the notches and first engagement member(s) as well as between the support surface and the second engagement member(s), and a locked position securing the second engagement member(s) relative to the support surface. The arrangement of the support surface relative to the locking member is such that the force exerted on the second engagement member(s) retains the first engagement member(s) in the aforesaid notches.

6 Claims, 12 Drawing Figures

TOOL MOUNTING APPARATUS

BACKGROUND OF THE INVENTION

This invention relates to an apparatus which is suited for, although not strictly limited in use to, the detachable mounting of tool components on carriers, particularly vehicular type earth moving and digging equipment.

Conventional tool mounting devices of the type referred to above are described in U.S. Pat. Nos. 3,220,487; 3,220,579 and 4,030,470. The present invention is directed to an improvement over such conventional devices. Characteristics of the present invention include a more reliable and rigid coupling of the tool components to their respective carriers, as well as other advantageous features to be hereinafter described in more detail.

SUMMARY OF THE INVENTION

According to one aspect to the invention, a tool mounting apparatus for detachably mounting a tool component on a carrier comprises a power hitch component connected to the carrier, either rigidly or in a pivotally adjustable manner. Notch means on one of these components is arranged to receive first engagement means fixed relative to the other of these components. A support surface on the power hitch component is arranged to engage second engagement means on the tool component. A power actuated locking means is mounted on the power hitch component for movement in a single mechanical motion between an unlocked position permitting relative engagement and disengagement between the notch means and the first engagement means as well as between the support surface and the second engagement means, and a locked position securing the second engagement means relative to the support surface. The arrangement of the support surface relative to the notch means is such that the force exerted on the second engagement means by the power actuated locking means is at least partially resolved into one or more force components seating the first engagement means in the notch means. This produces a secure coupling between the tool component and the carrier via the power hitch component.

Advantageously, the power actuated locking means consists of a locking arm pivotally mounted on the power hitch component for movement between the aforesaid unlocked and locked positions. Preferably, the arm is pivotly manipulated by means of a piston-cylinder unit which can be controlled remotely from any convenient location such as the operating console of the vehicle, thus avoiding any necessity for the operator to leave the vehicle during coupling or uncoupling of the tool component.

The aforesaid first and second engagement means may consist of bars arranged in parallel relationship on the tool component, with the support surface on the power hitch component being arranged at an angle relative to a plane containing the bars when the latter are in respective engagement with the notch means and the support surface. Preferably, the aforesaid angle is acute.

In one aspect of the invention to be hereinafter described in greater detail, the power hitch component is pivotally connected to the dipper stick of a back hoe. In another aspect of the invention also to be described hereinafter in greater detail, the power hitch component is adapted to be connected directly to the chassis of a tractor or other like vehicle.

DETAILED DESCRIPTION OF INVENTION

Figure 1:
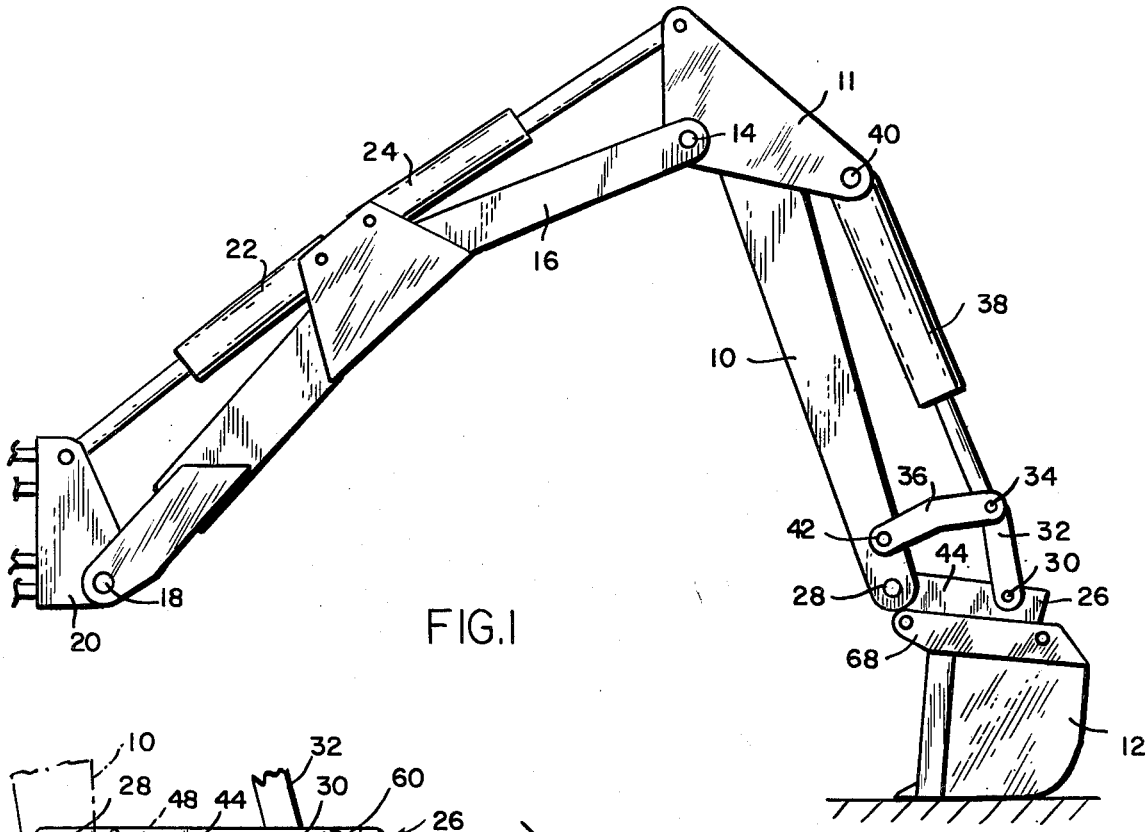
FIG. 1 is a view in side elevation showing a tool mounting apparatus in accordance with the present invention, used in mounting a bucket on the dipper stick of a backhoe.

Referring initially to FIG. 1 of the drawings, a carrier consisting of a backhoe dipper stick 10 is shown connected to a tool component or bucket 12. The dipper stick is fixed relative to spaced plates 11 which are pivotally connected in a conventional manner at 14 to a boom 16. Boom 16 is in turn pivotally connected at 18 to a turret 20. Pivotal movement of the boom 16 relative to the turret is controlled by a double acting hydraulic piston-cylinder unit 22. Another double acting hydraulic piston-cylinder unit 24 controls pivotal movement of the dipper stick 10 relative to the boom 16.

A power hitch component 26 is pivotally connected at 28 to the dipper stick 10 and at 30 to a control link 32, the latter being pivotally connected at 34 to an intermediate pivotal support link 36 and to another hydraulic piston-cylinder unit 38. Unit 38 is pivotally connected at 40 to plates 11, and support link 36 is pivotally connected at 42 to dipper stick 10. Unit 38 serves as the means for pivotally manipulating the power hitch component 26 and attached bucket 12 relative to the dipper stick 10.

As can best be seen by further reference to FIGS. 2A–3B, power hitch component 26 includes a basic frame consisting of side members 44, 46 joined by intermediate transversally extending bifurcated spacer members 48, 50. The side members 44, 46 are reduced in thickness as at **44*a*, 46*a*. The power hitch component has notch means 52 at one end and a support surface 54** at the opposite end.

A power actuated locking means is mounted on the power hitch component. Preferably, the power actuated locking means consists of a locking arm 58 pivotally mounted at 60 to spacer member 50. A piston-cylinder unit 64 is pivotally connected at one end at 62 to the arm 58 and at the opposite end at 66 to spacer member 48. Piston-cylinder unit 64 is connected hydraulically in the same manner as units 22, 24 and 38 via flexible hydraulic lines (not shown) to a remotely located control console at which an operator may remain stationed during operation of the apparatus.

The tool component or bucket 12 is provided with rearwardly extending plates 68, 70 spanned by relatively fixed and parallel first and second engagement means consisting of bars 72, 74.

Figure 2A:
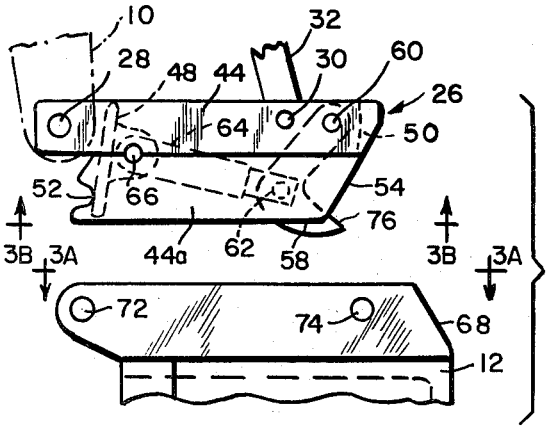
FIG. 2A is an enlarged partial side elevational view of the apparatus shown in FIG. 1, with the power hitch component disconnected from the bucket.
Figure 2B:
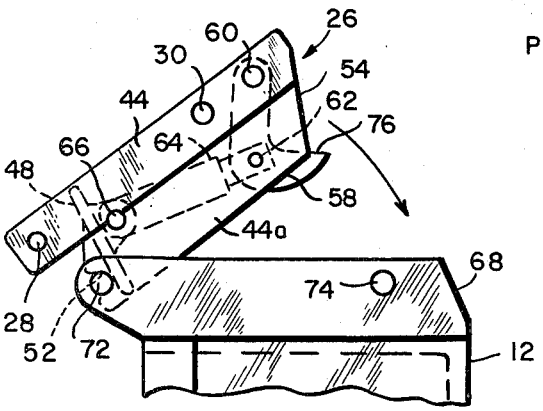
FIG. 2B is a view similar to FIG. 2A showing an intermediate stage in the coupling of the power hitch component to the bucket.
Figure 2C:
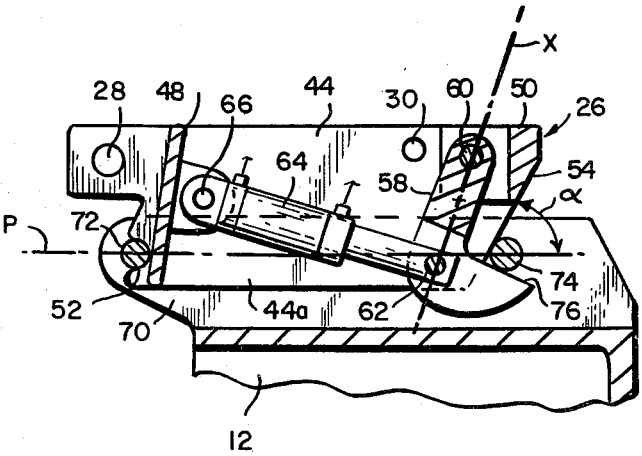
FIG. 2C is a sectional view showing the power hitch component securely coupled to the bucket.
Figure 3A:
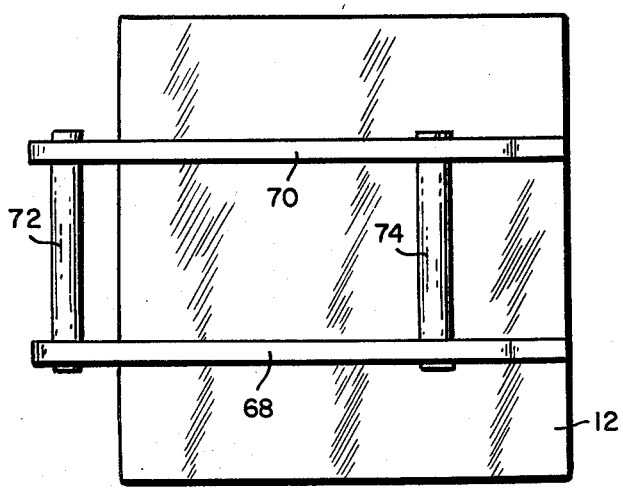
FIGS. 3A and 3B are views respectively taken along lines 3A—3A and 3B—3B of FIG. 2A.
Figure 3B:
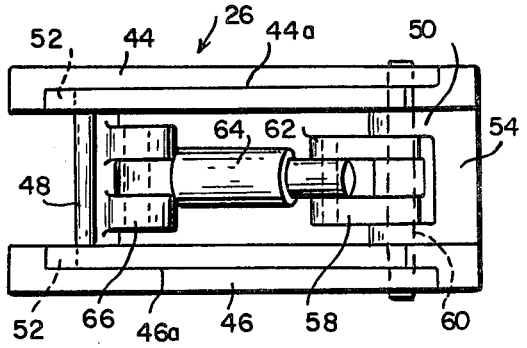
Figure 5:
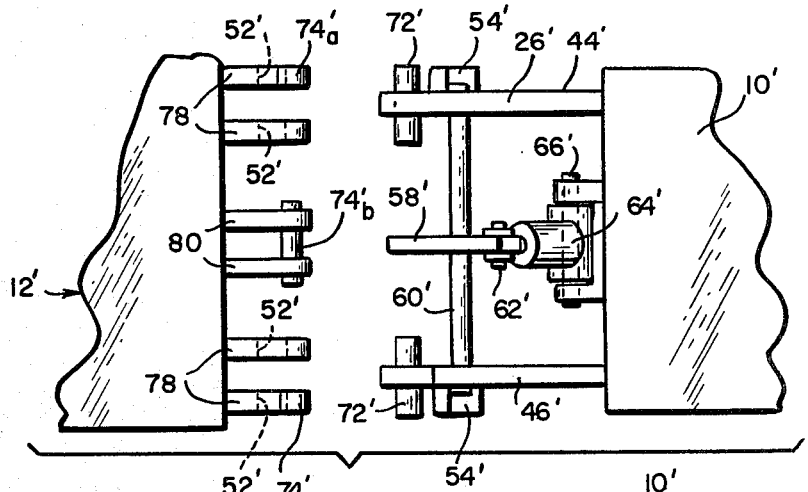
FIG. 5 is a plan view of the apparatus shown in FIG. 4.
Figure 4:
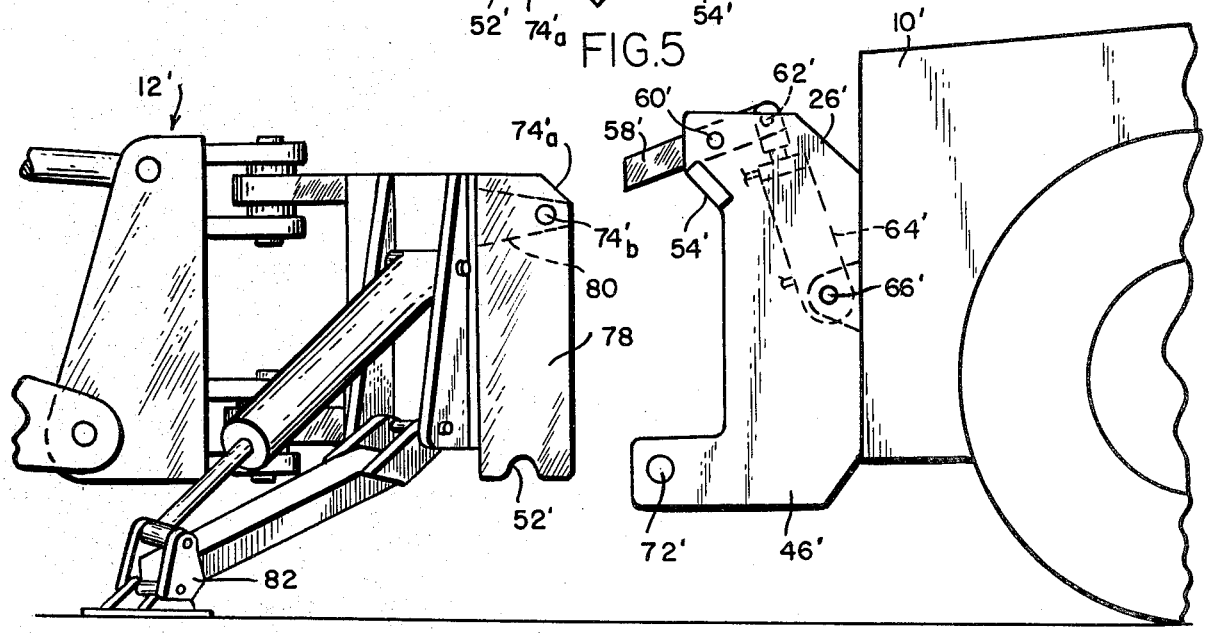
FIG. 4 is a side elevational view of an alternate embodiment of a tool mounting apparatus in accordance with the present invention, used in mounting a backhoe attachment on the chassis of a tractor, and shown in the uncoupled state.
Figure 7:
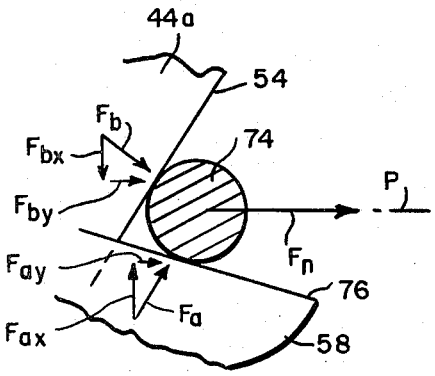
FIG. 7 is a diagrammatic illustration of the forces exerted on the second engagement means in the embodiment shown in FIGS. 1–3.

The tool mounting apparatus shown in FIGS. 1–3B operates in the following manner: as shown in FIG. 2A, the locking arm 58 is first pivoted to an unlocked position permitting relative engagement and disengagement between the notch means 52 and the first engagement means 72, and between the support surface 54 and the second engagement means 74. The boom 16 and dipper stick 10 are next manipulated to position the power hitch component as shown in FIG. 2B, with the first engagement means 72 seated in the notch means 52. Piston-cylinder unit 38 is then actuated to pivot the power hitch component 26 about the axis of first engagement means 72 in a clockwise direction as viewed in the drawings, to the position shown in FIG. 2C, thereby placing the support surface 54 in engagement with the second engagement means 74. Once this has been accomplished, piston-cylinder unit 64 is actuated to pivot locking arm 58 into its locked position as shown in FIG. 2C. It will be understood that as this occurs, the second engagement means 74 will be slidably engaged by both support surface 54 and a face 76 on arm 58. Face 76 is disposed at angle relative to a plane "X" containing pivot axis 60 and 62. Also, as the arm 58 undergoes pivotal motion, the angle between face 76 and the longitudinal axis of piston cylinder unit 64 varies. As is best shown in FIG. 7, locking arm 58 acts on second engagement member 74 with a force $F_a$. Surface 54 likewise acts on second engagement member 74 with a force $F_b$. The forces $F_a$ and $F_b$ are angularly directed away from notch means 52 and first engagement means 72, and along an imaginary plane "P" containing the first and second engagement members 72, 74. Forces $F_a$, $F_b$ can each be resolved into opposed forces $F_{ax}$ and $F_{bx}$ perpendicular to plane P, and forces $F_{ay}$ and $F_{by}$ parallel to plane P. Forces $F_{ay}$ and $F_{by}$ combine to produce a net force $F_n$ on second engagement means 74. Force $F_n$ pulls the first engagement means 72 into notch means 52. Thus, when the apparatus is in the fully locked position, first engagement means 72 is firmly and securely seated in notch means 52 and second engagement means 74 is firmly and positively secured relative to the support surface 54. The net result is thus a rigid coupling between the tool component or bucket 12 and the carrier or dipper stick 10 via the power hitch component 26. This rigid coupling can be achieved by appropriate operation of hydraulic piston-cylinder units 22, 24, 38 and/or 64 from a remote control console, thereby promoting both safety and efficiency.

Preferably, and as is best shown in FIG. 2C, the support surface 54 is inclined at an angle $\alpha$ relative to plane P when the first engagement means 72 is received in the notch means 52 and the second engagement means 74 is in contact with the support surface 54.

In light of the above, it will be understood that movement of the locking arm 58 between its locked and unlocked positions occurs in a single mechanical motion, which represents a distinct improvement over known prior art arrangements which involve multiple mechanical motions.

An alternate embodiment of the invention is illustrated in FIGS. 4–6C. Here, the tool component 12' consists of a backhoe attachment and the carrier 10' is the chassis of a vehicle. The power hitch component 26' is rigidly secured to the carrier 10', and again includes spaced side members 44', 46'. A hydraulic piston-cylinder unit 64' pivotally connected at one end at 66' to a bracket on the carrier 10' and at the opposite end at 62' to an arm 58'. Arm 58' is pivotally mounted on a shaft 60' extending between the side members 44', 46'.

The side members 44', 46' carry both first engagement means in the form of short laterally extending pins 72' and laterally protruding plates which define inclined support surfaces 54'. The tool component 12' has rearwardly extending pairs of spaced parallel plates 78 defining notch means 52' at their lowermost ends. In this embodiment, the second engagement means is comprised of bevelled surfaces $74'_a$ at the upper ends of the outermost plates 78, and a cross pin $74'_b$ carried by a pair of brackets 80 protruding rearwardly from the tool component 12' for engagement with arm 58'.

Figure 6A:
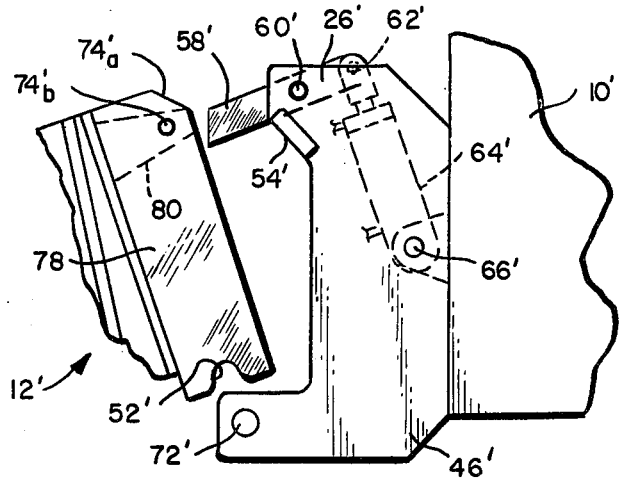
FIGS. 6A–6C are somewhat schematic views depicting various stages in the coupling operation of the embodiment shown in FIGS. 4 and 5.

This alternate embodiment operates in the following manner: the tool component 12' is conventionally provided with a boom and dipper stick (not shown) and hydraulically actuated lateral stabilizers 82, all as described in a number of prior art patents, for example U.S. Pat. No. 3,220,487. The boom and stabilizers are first operated to raise the tool component and to incline the rearwardly protruding plates 78 at an angle, as shown in FIG. 6A. Once this has been accomplished, the carrier 10' is advanced to position first engagement means 72' beneath notch means 52', again as shown in FIG. 6A. At this point, the pivotal arm 58' is in its unlocked position.

Figure 6B:
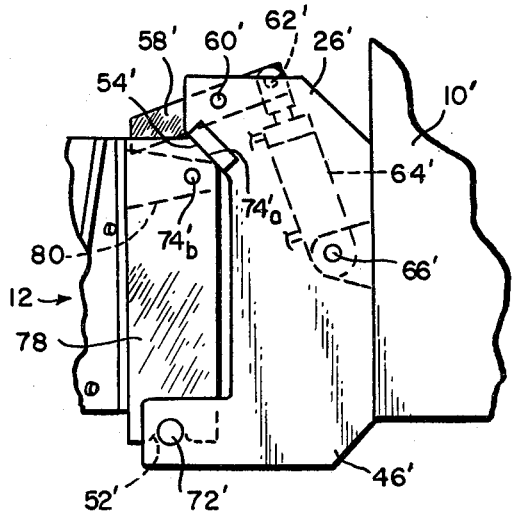
Figure 6C:
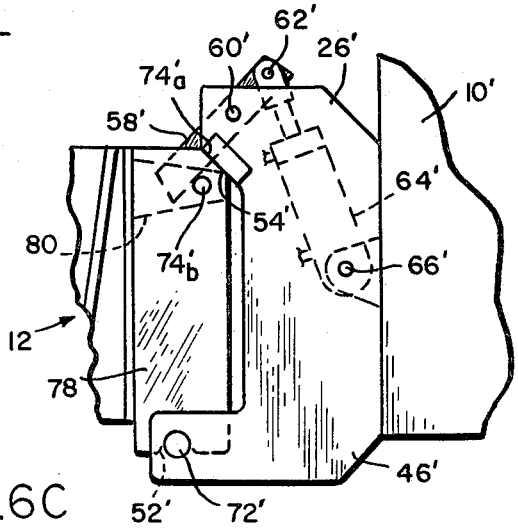

The tool component's boom and stabilizers are then operated to lower and vertically align the plates 78 as shown in FIG. 6B. This places the first engagement means 72' in the notch means 52', and brings the second engagement means $74'_a$ into engagement with support surfaces 54'. Once this has been accomplished, piston-cylinder unit 64 is operated to pivot locking arm 58' to its locked position in engagement with pin $74'_b$, as shown in FIG. 6C. The force exerted by arm 58' on pin $74'_b$ pulls the second engagement means $74'_a$ against surfaces 54'. The relative inclination of the surfaces 54' produces a resultant force in a direction towards notch means 52' and first engagement means 72' which firmly seats the first engagement means 72' in the notch means 52'. The net result is again a rigid coupling of the tool component 12' to the carrier 10' via the power hitch component 26'.

In light of the above, it will now be evident to those skilled in the art that modifications can be made to the embodiments herein chosen for purposes of disclosure. For example, under certain circumstances it might be advantageous to substitute a sliding arm for the pivotal arms 58 and 58' herein disclosed. It might also be desirable to vary the angular relationships of various components, particularly those of the support surfaces 54, 54' and the faces 76, 76' on the pivotal arms. It also might be advantageous to provide the notch means on either component and on either end of said components, the same being true of the support surface. For example, in the embodiment shown in FIGS. 1–3B the notch means 52 is located on the power hitch component 26, whereas in the embodiment shown in FIGS. 4–6C, the notch means 52' is located on the tool component 12'. Thus it will be seen that the notch means can be provided at any desirable location by rearranging the location of other cooperating components such as the engagement means, support surface and the locking means. These and numerous other modifications are included within the scope of the claims appended hereto.

I claim:

1. A tool mounting apparatus for detachably mounting a tool component to a carrier, said apparatus comprising:

(a) a power hitch component mounted to said carrier, said power hitch component having a first contact surface with a leading end, an intermediate portion, and a trailing end;

(b) first and second engagement members on said tool component;

(c) notch means on said power hitch component, said first engagement member and said notch means configured to lockingly engage one another;

(d) lock means mounted to said power hitch component for movement relative thereto, said lock means having a second contact surface with a leading end, an intermediate portion and a trailing end, said lock means being movable between an unlocked position and a locked position; and (e) means for moving said lock means between said unlocked and locked positions;

(f) movement of said lock means from its unlocked position to its locked position causing relative movement between said second engagement member and said power hitch component from said intermediate portion toward said trailing end of said first contact surface and relative movement between said second engagement member and said lock means from said intermediate portion toward said trailing end of said second contact surface, said intermediate portion initially first contacting said second engagement member as said lock means moves from said unlocked position to said locked position;

(g) movement of said lock means from its unlocked position to its locked position also causing relative movement between said power hitch component and said tool component for lockingly engaging said notch means and said first engagement member and clamping said tool component to said power hitch component.

2. The apparatus of claim 1 wherein said lock means includes a locking arm mounted to said power hitch component for pivoting movement between said locked and unlocked positions and wherein said moving means includes a piston cylinder unit carried by said power hitch component, said piston cylinder unit operative to move said locking arm between said locked and unlocked positions.

3. The apparatus as claimed in claim 2 wherein the distance between said notch means and said leading end of said second contact surface is less than the distance between said first and second engagement members when said locking arm is in said unlocked position and the distance between said notch means and said leading end of said second contact surface is greater than the distance between said first and second engagement means when said locking arm is in said locked position.

4. Tool mounting apparatus for detachably mounting a tool component on a carrier, comprising: a power hitch component connected to the carrier, notch means on one of said components arranged for locking engagement with a first engagement means on the other of said components; power actuated locking means mounted on said power hitch component for selectively engaging a second engagement means on said tool component; said power actuated locking means being movable between locked and unlocked positions; a first support surface on one of said components for engaging a second support surface on the other of said components, said first engagement means being received in said notch means and said first support surface being in contact with said second support surface when said power actuated locking means is in said unlocked position, with movement of said power actuated locking means to said locked position causing said first engagement means to be interlocked with said notch means and said tool component to be clamped to said power hitch component, movement of said locking means to said unlocked position causing said tool to self detach from said hitch component when said tool component is in a raised position, the distance between said notch means and said second engagement means being less than the distance between said first engagement means and a leading end of said locking means when said locking means is in said unlocked position and the distance between said notch means and said second engagement means being greater than the distance between said first engagement means and said leading end of said locking means when said locking means is in said locked position.

5. Tool mounting apparatus for detachably mounting a tool component on a carrier, comprising: a power hitch component connected to the carrier; notch means on one of said components arranged for locking engagement with a first engagement means on the other of said components; power actuated locking means mounted on said power hitch component for selectively engaging a second engagement means on said tool component; said power actuated locking means being movable between locked and unlocked positions; a first support surface on one of said components for engaging a second support surface on the other of said components; said first engagement means being received in said notch means and said first support surface being in contact with said second support surface when said power actuated locking means is in said unlocked position, with movement of said power actuated locking means to said locked position causing said first engagement means to be interlocked with said notch means and said tool component to be clamped to said power hitch component, the distance between said notch means and second engagement means being less than the distance between said first engagement means and a leading end of said locking means when said locking means is in said unlocked position, and the distance between said notch means and said second engagement means being greater than the distance between said first engagement means and said leading end of said locking means when said locking means is in said locked position.

6. Tool mounting apparatus for detachably mounting a tool component on a carrier, comprising: a power hitch component connected to the carrier; receiving means on one of said components arranged for locking engagement with a first engagement means on the other of said components; power actuated locking means mounted on said power hitch component for selectively engaging a second engagement means on said tool component; said power actuated locking means being movable between locked and unlocked positions; a first support surface on one of said components for engaging a second support surface on the other of said components; said first engagement means being received in said receiving means and said first support surface being in contact with said second support surface when said power actuated locking means is in said unlocked position, when said power actuated locking means is moved to said locked position, said first engagement means is received in said receiving means and said tool component is clamped to said power hitch component, the distance between said receiving means and said second engagement means being less than the distance between said first engagement means and a leading end of said locking means when said locking means is in said unlocked position, and the distance between said receiving means and said second engagement means being greater than the distance between said first engagement means and said leading end of said locking means when said locking means is in said locked position.

* * * * *